United States Patent [19]

Ohly

[11] Patent Number: 4,583,740

[45] Date of Patent: Apr. 22, 1986

[54] GOLF SWING MUSCLE TRAINING DEVICE

[75] Inventor: Richard L. Ohly, Orlando, Fla.

[73] Assignee: Swing Plane Systems, Inc., Orlando, Fla.

[21] Appl. No.: 563,233

[22] Filed: Dec. 19, 1983

[51] Int. Cl.[4] ..... A63B 69/36

[52] U.S. Cl. ..... 273/191 A; 273/193 A

[58] Field of Search ..... 273/186 A, 191 A, 191 R, 273/191 B, 192, 193 R, 193 A, 193 B, 194 R, 194 A, 194 B

[56] References Cited

U.S. PATENT DOCUMENTS

| | | | |
|---|---|---|---|
| 1,039,491 | 9/1912 | Collins et al. | 273/193 R |
| 1,399,761 | 12/1921 | Garland | 273/191 A |
| 1,960,787 | 5/1934 | MacStocker | 273/191 A |
| 2,520,287 | 8/1950 | Plunkett | 273/191 A |
| 2,653,025 | 9/1953 | Zega | 273/191 A |
| 2,713,491 | 7/1955 | Plunkett | 273/191 A |
| 3,744,799 | 7/1973 | Hightower | 273/191 A |
| 3,794,329 | 2/1974 | Wilson | 273/191 A |
| 4,040,631 | 8/1977 | Flippin | 273/191 A |
| 4,040,633 | 8/1977 | Sciarrillo | 273/191 A |

*Primary Examiner*—George J. Marlo

*Attorney, Agent, or Firm*—Edward M. Livingston

[57] ABSTRACT

A device for teaching and practicing a proper golf swing, which enables the user to exercise and build the muscles necessary to a strong and effective golf swing, is provided for by this invention.

The device consists of a tubular guide for directing a golf club during the proper swing, and a modified golf club with a weight mounted between two springs on said club for use with said device. The weight on the golf club is removable and thus may be varied depending upon the user's desired amount of weight. In addition to these benefits this invention is designed to allow the user to practice his or her golf swing while actually hitting a golf ball.

3 Claims, 6 Drawing Figures

(A-A)

(B–B)

GOLF SWING MUSCLE TRAINING DEVICE

BACKGROUND OF THE INVENTION

This invention relates to athletic training apparatuses and more particularly, to devices for teaching and practicing the proper golf swing.

The prior art includes numerous devices which have attempted to result in publicly accepted devices to be used to teach the correct golf swing. Beyond the lack of public acceptance, a major problem with these devices has been that they have been too complex in their construction, and thus, too expensive to manufacture. A further problem, and the major one in the opinion of this inventor, is that none of the devices in the prior art are designed to both teach and practice the proper golf swing, and at the same time, exercise and build the pertinent muscles necessary for achieving a successful golf swing. Also, a problem with many of the devices is that they do not allow an adequate view of the swing area around the golf ball.

The instant invention solves these problems by providing a simply constructed and inexpensive device, containing a grooved tube, along which there are means to allow circular weight to move along the arc of the proper golf swing. The device also includes a modified golf club, to which said weighted slide is attached. The design of the groove tube also enables the user not only to teach and exercise the muscles necessary for the proper golf swing, but also to allow the user to actually hit a golf ball while using the device.

SUMMARY OF THE INVENTION

In accordance with the foregoing background discussion, a major object of this invention is to provide a device for teaching and practicing the correct golf swing.

Another object of this invention is to provide a device which also exercises and builds the pertinent muscles necessary for a proper and strong, effective golf swing.

A further object of this invention is to provide a device which is simple, in that it is not complex to construct and inexpensive to manufacture, thereby making it available to a large portion of the general public.

Still a further object of this invention, is to provide a device which allows the user to not only practice an actual golf stroke, but to also hit golf balls while using same. Said balls can be hit at a target, thereby giving a user a realistic feeling for the completion of the golf stroke.

The instant invention accomplishes these and other objects by providing a device which consists of a combination of a tubular shaped guide, designed to guide a modified and weighted golf club on both a forward and backward upswing. The tubular guide for the golf club is affixed to a floor base and back-braced enclosure, which supports it in an upright, vertical position. The front and rear portions of the tube are designed to match the proper golf swing, thereby enabling the user to learn and practice the proper swing.

While teaching the user the proper golf swing, the instant device, at the same time, provides the modified, weighted golf club, which moves within said tubular guide. The modified golf club contains a weighted slide, which allows sufficient clearance betweeen it and the sides of the guide. The purpose of the weight is to exercise and build the pertinent muscles necessary for an effective and strong golf stroke.

The tubular guide also provides an opening at the bottom of the tube through which the head of the golf club can extend to hit a golf ball, while the user is swinging the golf club in the invention. A target can even be set up in front of the device for the user to determine the accuracy and distance of his drive.

DESCRIPTION OF THE PREFERRED EMBODIMENTS

Figure 1:
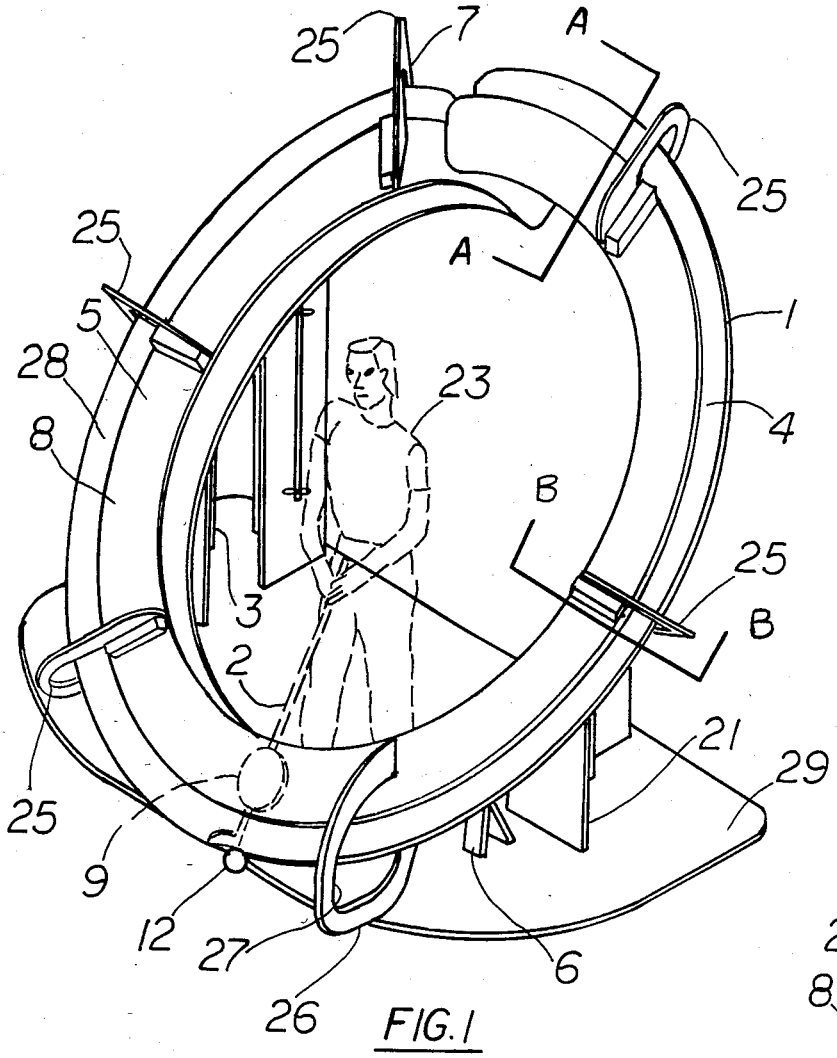
FIG. 1 is a perspective view showing the invention in use.

Referring now in detail to the drawings, FIG. 1 illustrates the entire invention in the perspective, as it would appear during use. The swing guide itself, designated by 1, which can be made of wood, plastic, or other material, contains both a front portion 4 and rear portion 5, which appear in juxtaposition to each other to form a curvilinear arc of the correct golf swing. The guide 1 is supported by rear and front adjustable supports, 3 and 21, respectively, and braces 6, which in turn, are all attached to a base platform, 29. A golf club 2, as modified and described in more detail hereinafter, is placed into the bottom portion of the golf device 1. The device 1 contains the correct width 17, both to retain the golf club 2, yet allowing adequate freedom for swinging said club. When swinging the golf club 2, the ball 12 can be hit forward through the opening 27 in the bottom brace 26 of the device.

Figure 2:
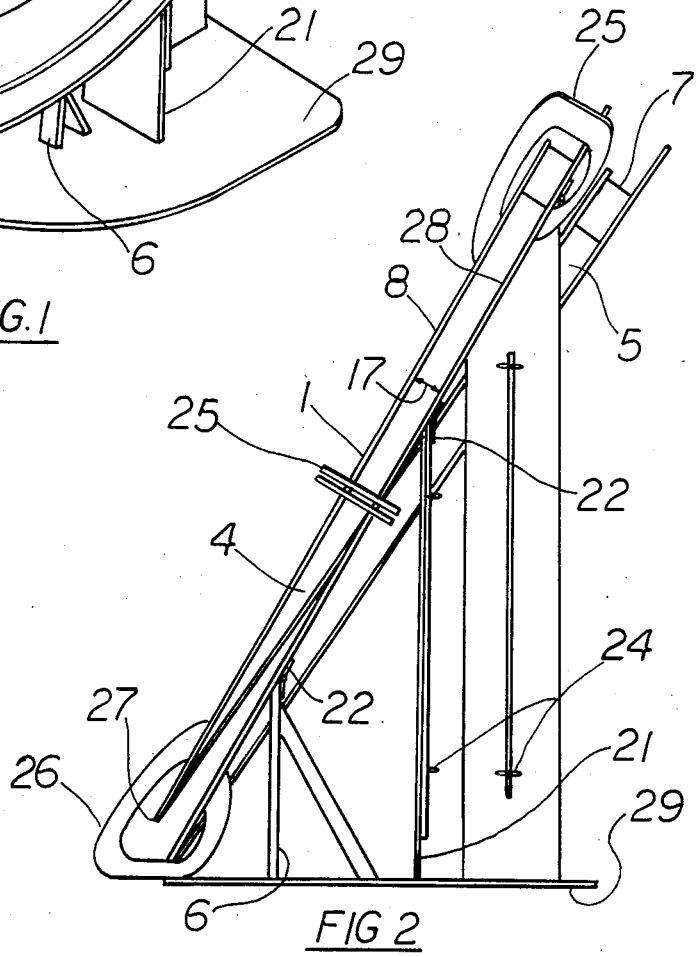
FIG. 2 is a front view of the device.

In FIG. 2, a front view of the device is llustrated. FIG. 2 shows the opening 27 in the bottom brace 26 in the device through which the ball passes when hit by the golf club 2. The width of the tubular element shown as 17 is just enough to clear the modified golf club 2, with weight 9, and still retain and guide the club 2 during its front and rear swing.

Figure 3:
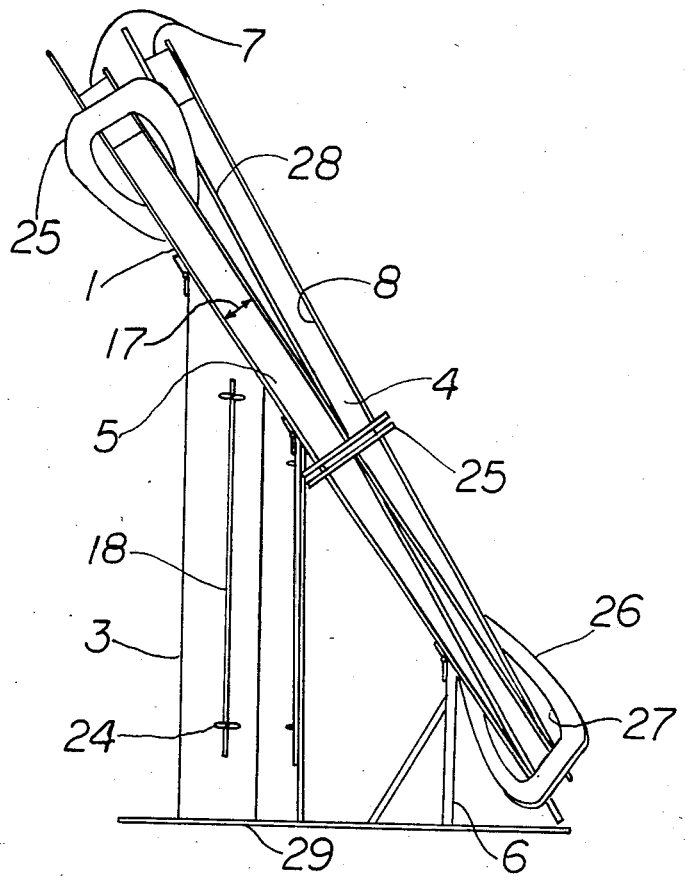
FIG. 3 is a rear view of the device.

FIG. 3 shows a rear view of the device, which shows the base platform 29, adjustable rear support 3 and brace 6 which supports the rear portion 5 of device 1, in an upright, vertical position. The rear support 3 (just like the front support shown as 21 in FIG. 2) is adjustable upward or downward according to the height of the user merely by unfastening wing nuts 24, and moving the upper part of the support 3 or 21 up or down until the desired height is reached and then refastening the wing nuts 24 on the adjustment slot 18. Two stops 7 which can be made of foam rubber or a similar material are contained in the top of the foreward and backward arc of the device to prevent the club 2 with weight 9 from extending beyond the proper arc of a golf swing.

Figure 4:
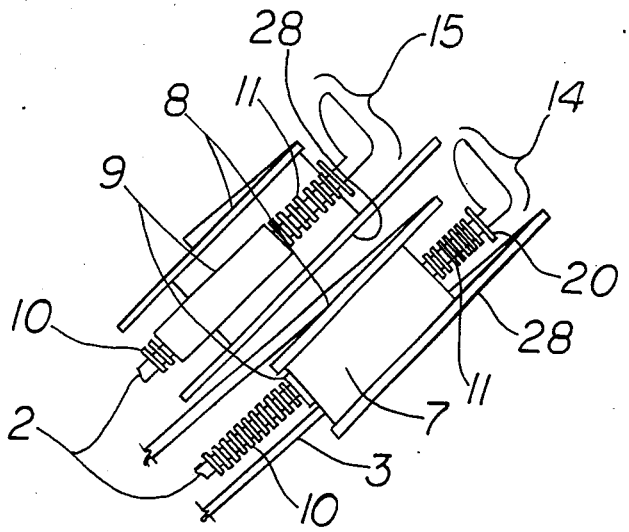
FIG. 4 is a front cross-sectional view of the device along lines A—A of FIG. 1.

A cross-section of the device along the lines of A—A of FIG. 1 is illustrated in FIG. 4. The golf club 2, is illustrated in both the back swing and front swing positions, 14 and 15, respectively.

In order to provide clearance for the golf club head 31 during the swinging motion, the outer circumference 32 of the slide surface 28 is approximately 2 inches more than the outer circumference 33 of the retaining surface 8.

Figure 5:
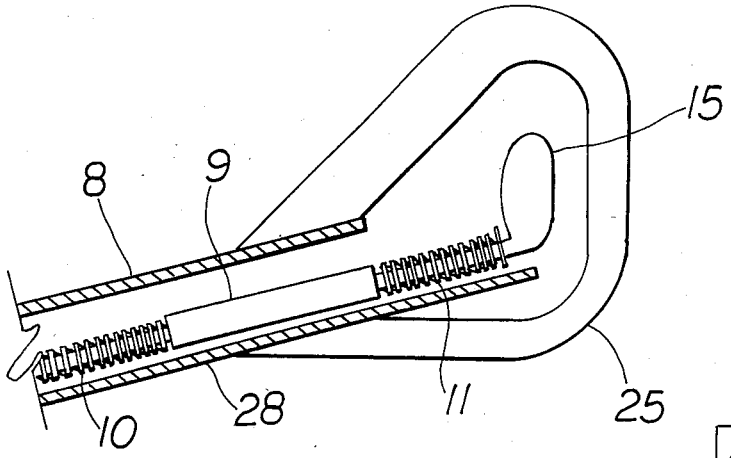
FIG. 5 is a cross-sectional view of a portion of the invention along the lines B—B of FIG. 1.

FIG. 5 shows a cross section along the lines B—B of FIG. 2 of just the forward swing portion 4 of the device. FIG. 5 clearly shows how the braces 25 separate the sliding surface 28 and retaining surface 8 just enough to control the golf club during the swing, yet provide the freedom necessary for training.

Figure 6:
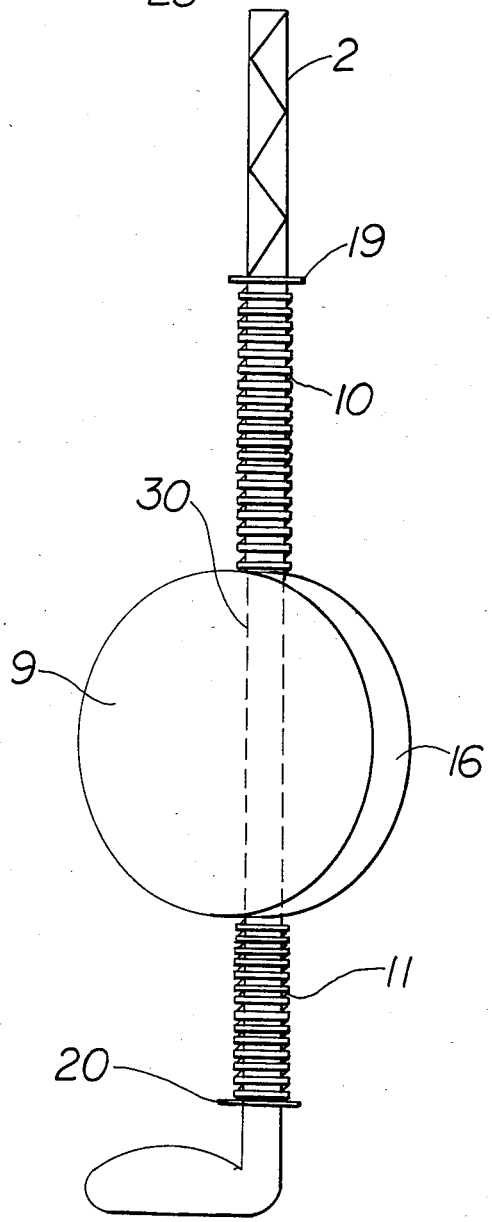
FIG. 6 is a partial side view of the modified, golf club of this invention.

The final drawing, FIG. 6, shows a detailed, partially cut-away side view of the modified golf club 2 used in the invention. Said golf club 2 consists of a modified wood or iron, depending upon the club with which the user may need practice. A bottom collar, depicted by 20, is affixed just above the hitting portion of the club 2 and just below the retaining spring 11, which is placed over said collar 20. The weighted slide depicted by 9, has a hole drilled through its center, through which it receives the shaft 30 of the club 2. The slide 9 has a thickness 16 of between one and two inches. The weighted slide 9 may be made of wood and covered by formica, or from plastic. Above the weighted slide 9 is a spring 10 which is retained by an upper washer-type collar 19. The purpose of the springs 10 and 11, is to decrease the effects of the centrifugal force caused by the weight during the swing of the club. The weight 9 is designed to be made in various weights, which can be easily inserted onto the club by the user at the various weights desired.

In summary, this invention provides a device which allows one not only to learn and practice a proper golf swing, but also enables the user to exercise and build those muscles necessary for a strong and effective golf swing. At the same time it accomplishes the above purposes, it allows the user to actually hit the ball while using the device, thereby making an adjustment from the practice on the device to actual play on the golf course much easier.

While the preferred embodiments of the invention and the various modes of utilization have been described in detail hereinabove, it should be understood that various modifications may be made from the specific details described herein, without departing from the spirit and scope of the invention.

Having thus described my invention, I claim the following:

1. A device for teaching and practicing a golf swing and for building the muscles necessary thereto, comprising a curvilinear, tubular guide, having a shape determined by the arc of the proper golf swing, said guide having forward swing and back swing portions, having a width sufficient to contain a modified golf club, and a modified golf club containing a collar just above the hitting portion with a spring on top of said collar over which a circular weight is placed, said weight having a hole extending diametrically through it to enable it to be mounted on the shaft of the golf club, and further having coiled springs around said shaft, between the weight and the collar to help reduce the effects of centrifugal force during the golf swing.

2. A device for teaching and practicing the proper golf swing and building the muscles necessary thereto, comprising (a) a curvilinear tubular guide conforming to the arc of a prescribed golf club swing having an outer retaining surface and inner sliding surface;

(b) connector means attached to the retaining and sliding surfaces to hold said surfaces positioned apart a sufficient distance along the curvilinear arc of the tubular guide to receive the shaft of a golf club;

(c) two stops at both ends of the curvilinear tubular guide;

(d) two supports, both adjustable by means of two slidable components movable up and down and secured in any position by means of readily tightened fasteners, one support being attached to the front portion of the tubular guide and the other support to the rear portion of the tubular guide;

(e) small supporting braces as needed to keep tubular guide shaped in the arc of a golf swing; and (f) a modified weighted golf club for use in combination with said tubular guide having a changeable weight diametrically mounted on the club shaft between two coiled springs and two retaining bands or collars to hold the springs and weight in position on the club.

3. A weighted golf club for exercising and building muscles necessary for strong and effective golf swing, comprising a golf club containing a collar affixed to said club, just above the hitting portion of the club, a small coiled spring fitting around the shaft of the club, just above the hitting portion of the club, a small coiled spring fitting around the shaft of the club, just above said collar, a circular weight containing a hole through the diameter of said weight for insertion of the club through same, a coiled spring on the top of the weight mounted on the shaft of the golf club, with a collar affixed to the golf club shaft to retain said spring and weight during the golf swing.

* * * * *